US006042528A

United States Patent [19]

McCumber et al.

[11] Patent Number: 6,042,528

[45] Date of Patent: Mar. 28, 2000

[54] APPARATUS FOR BUFFERING, TURNING OVER, FOLDING AND ORIENTATING FORMS

[75] Inventors: Roger D. McCumber, Minnetonka; Benjamin H. Sannel, Minneapolis, both of Minn.

[73] Assignee: Datacard Corporation, Minneapolis, Minn.

[21] Appl. No.: 09/047,743

[22] Filed: Mar. 25, 1998

[51] Int. Cl.[7] ..... B31F 1/00

[52] U.S. Cl. ..... 493/420; 493/419

[58] Field of Search ..... 493/421, 420, 493/419, 249; 53/116, 117, 429

[56] References Cited

U.S. PATENT DOCUMENTS

| | | | |
|---|---|---|---|
| 2,190,413 | 2/1940 | Davidson | 271/49 |
| 3,951,399 | 4/1976 | Reist | 270/58 |
| 4,406,649 | 9/1983 | Yamamura . | |
| 4,616,815 | 10/1986 | Vijuk . | |
| 4,669,719 | 6/1987 | Fratangelo | 271/251 |
| 4,834,699 | 5/1989 | Martin | 493/421 |
| 4,903,908 | 2/1990 | Hansch | 242/59 |
| 5,004,222 | 4/1991 | Dobashi | 271/225 |
| 5,228,681 | 7/1993 | Arnold | 271/303 |
| 5,246,415 | 9/1993 | Fuss . | |
| 5,282,614 | 2/1994 | Kalisiak et al. | 271/227 |
| 5,289,251 | 2/1994 | Mandel et al. | 355/324 |
| 5,374,052 | 12/1994 | Folsom | 271/225 |
| 5,429,349 | 7/1995 | Supron et al. | 271/199 |
| 5,437,597 | 8/1995 | Boughton et al. | 493/240 |
| 5,449,165 | 9/1995 | Naramore | 271/225 |
| 5,472,185 | 12/1995 | Kollann et al. | 271/303 |
| 5,518,574 | 5/1996 | Yates et al. . | |
| 5,520,382 | 5/1996 | Nakajima | 271/188 |
| 5,615,537 | 4/1997 | Vollenweider | 53/466 |
| 5,667,214 | 9/1997 | Belec et al. . | |

FOREIGN PATENT DOCUMENTS

| | | |
|---|---|---|
| 0 406 827 A1 | 1/1991 | European Pat. Off. . |
| 91 04 607 U | 8/1991 | Germany . |
| WO 95/22462 | 8/1995 | WIPO . |

OTHER PUBLICATIONS

Bean, L., "Inverter Translation Device", *Xerox Disclosure Journal,* vol. 18, No. 4, pp. 439–441 (Jul./Aug. 1993).

Oagley, J., "Dual Velocity Paper Inverter", *Xerox Disclosure Journal,* vol. 12, No. 1, p. 43 (Jan./Feb. 1987).

*Primary Examiner*—Joseph J. Hail, III

*Attorney, Agent, or Firm*—Merchant & Gould P.C.

[57] ABSTRACT

A modular apparatus for processing printed sheets that are output from a high speed printer of a card processing system. The modular apparatus is capable of buffering or storing the sheets that are in progress in the printer when the system is stopped or paused, flips them so that they face upward, folds the sheets if necessary, and reorientates the sheets so that all sheets exit the module in the same orientation for further processing by the next module.

18 Claims, 4 Drawing Sheets

APPARATUS FOR BUFFERING, TURNING OVER, FOLDING AND ORIENTATING FORMS

FIELD OF THE INVENTION

The present invention relates to card processing systems which process information bearing plastic cards, such as credit cards, driver's licenses, identification cards and the like. More particularly, the present invention relates to a module for use in a card processing system in which the module is adapted to process printed sheets to which data bearing plastic cards are eventually attached.

BACKGROUND OF THE INVENTION

Card processing systems currently in use include apparatus for performing processing operations on the plastic cards, such as printing, embossing, laminating and the like, as well as including apparatus for producing and processing printed forms or sheets to which the plastic cards are subsequently attached for sending to customers.

The printed forms are often times produced in a high speed printer which is able to print up to 60 sheets per minute. The printed forms output from the printer are then handled by additional apparatus downstream of the printer to properly prepare the forms for receiving the plastic cards thereon. Each printed form contains personal information thereon related to a particular customer, with each printed form then being matched with the corresponding plastic card for the customer downstream of the printer. Typically these high speed printers are constructed such that the printed forms are output from the printer face down. However, this face down orientation of the forms is not conducive to subsequent handling and processing of the forms, and therefore the forms must flipped over at some point downstream of the printer so as to properly orientate the forms.

Additionally, the size of the paper used to print the forms may vary depending upon the requirements of the intended customer. Some customers may want conventional 8½×11 sized forms, while others may want 8½×14 or even 8½×17 sized forms. The printer will output an 8½×11 form with the long edge first, while the printer will output the 8½×14 and 8½×17 forms with the short edge first, such that the orientation of the forms output from the printer will vary based upon the size of the paper being used. In order to facilitate further operations on the forms, the printed forms must therefore be reoriented at some point downstream of the printer to a common orientation. Further, the larger 8½×14 and 8½×17 forms are usually folded down to 8½×11 size so that all the forms eventually have the same size, thereby facilitating further processing operations. Therefore, the card processing system must be designed to reorientate and fold the forms, in addition to flipping the forms so that they face upward.

Many current card processing systems are also formed as modular systems composed of a plurality of discrete modules, each of which is designed to perform a particular function or functions. The modules can be taken out of, or inserted into, the system so that the system can be adapted to the changing needs of the user. These modular systems are large and take up a lot of space, and therefore any reduction in the size of such a system while maintaining the same processing capabilities would be beneficial.

Often times, a module that is disposed downstream of a high speed printer will develop a fault which prevents the module from accepting any more forms, thereby requiring that the system be paused or stopped to correct the problem.

Previously, when this situation has occurred, the forms that are in progress in the printer must be thrown away since the sheets that are in progress in the printer cannot be stopped. Since each printed form contains personal information for a particular customer which must be mated downstream of the printer with the appropriate plastic card, it is time consuming and costly to reprint each of the customer specific printed forms and match the reprinted forms with the appropriate plastic card.

Thus, there is a need for a modular apparatus for use in a modular card processing system which is able to buffer, flip, fold and reorientate forms that are output from a high speed printer.

SUMMARY OF THE INVENTION

The present invention provides a modular apparatus for processing printed sheets that are output from a high speed printer of a card processing system. The modular apparatus is able to buffer the sheets should the card processing system need to be shut down or paused, flips them so that they face upward, folds the sheets if necessary, and reorientates the sheets so that all sheets exit the module in the same orientation for further processing by the next module.

In accordance with one embodiment of the present invention, a module is provided for processing printed sheets that are output from a printer. The module includes an input receiving the printed sheets from the printer, and a buffering and flipping means which is capable of holding a plurality of the printed sheets, as well as flipping the sheets. A folding means is provided which is capable of folding the printed sheets, and a reorientating means is provided for reorientating the printed sheets. An output position receives the reorientated printed sheets from the reorientating means.

The module in accordance with the present invention thus provides buffering, flipping, folding and reorientating within a single unit, thereby reducing the size of the card processing system with which it is used. Further, the buffering means is able to store the sheets that are in progress in the printer in case the card processing system is stopped or paused, thereby eliminating the need to throw away the sheets that are in progress in the printer when a pause or stop occurs. The stored or buffered sheets can then be used when the system is restarted.

In another embodiment of the present invention, an apparatus for processing printed sheets includes a buffering section capable of holding a plurality of the printed sheets. The buffering section includes a buffer wheel adapted for engagement with an edge of each of the plurality of sheets for separating the edges of the sheets, thereby making it easier to exit the sheets from the buffering section upon restarting the card processing system. A buckle folder is provided which is capable of folding the printed sheets, and a reorientating section receives the printed sheets for reorientating the printed sheets. By utilizing the buffer wheel to keep the edges of the sheets separate, a separate sheet separating step is not required and the sheets are more easily discharged from the buffering section once the system is restarted.

In yet another possible embodiment in accordance with the principles of the present invention, an apparatus for processing printed sheets includes a buffering section capable of holding a plurality of the printed sheets. A buckle folder is provided which is capable of folding the printed sheets when necessary, and a reorientating section receives the printed sheets for reorientating the sheets. The printed sheets enter the reorientating section in a first direction, and the reorientating section includes means for rotating the printed sheets and means for moving the printed sheets in a direction transverse to the first direction.

When the printer outputs certain sheets, such as standard 8½×11 size sheets, the sheets bypass the buckle folder and proceed directly to the reorientating section where they are moved in the transverse direction to an output position. Longer sheets, such as 8½×14 or 8½×17 size sheets, that are output by the printer are folded by the buckle folder and then directed to the reorientating section, where they are rotated into the proper orientation and then moved in the transverse direction to the output position. In this manner, each sheet exits the module of the present invention in the same orientation, no matter the size or orientation of the sheets being output from the printer.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
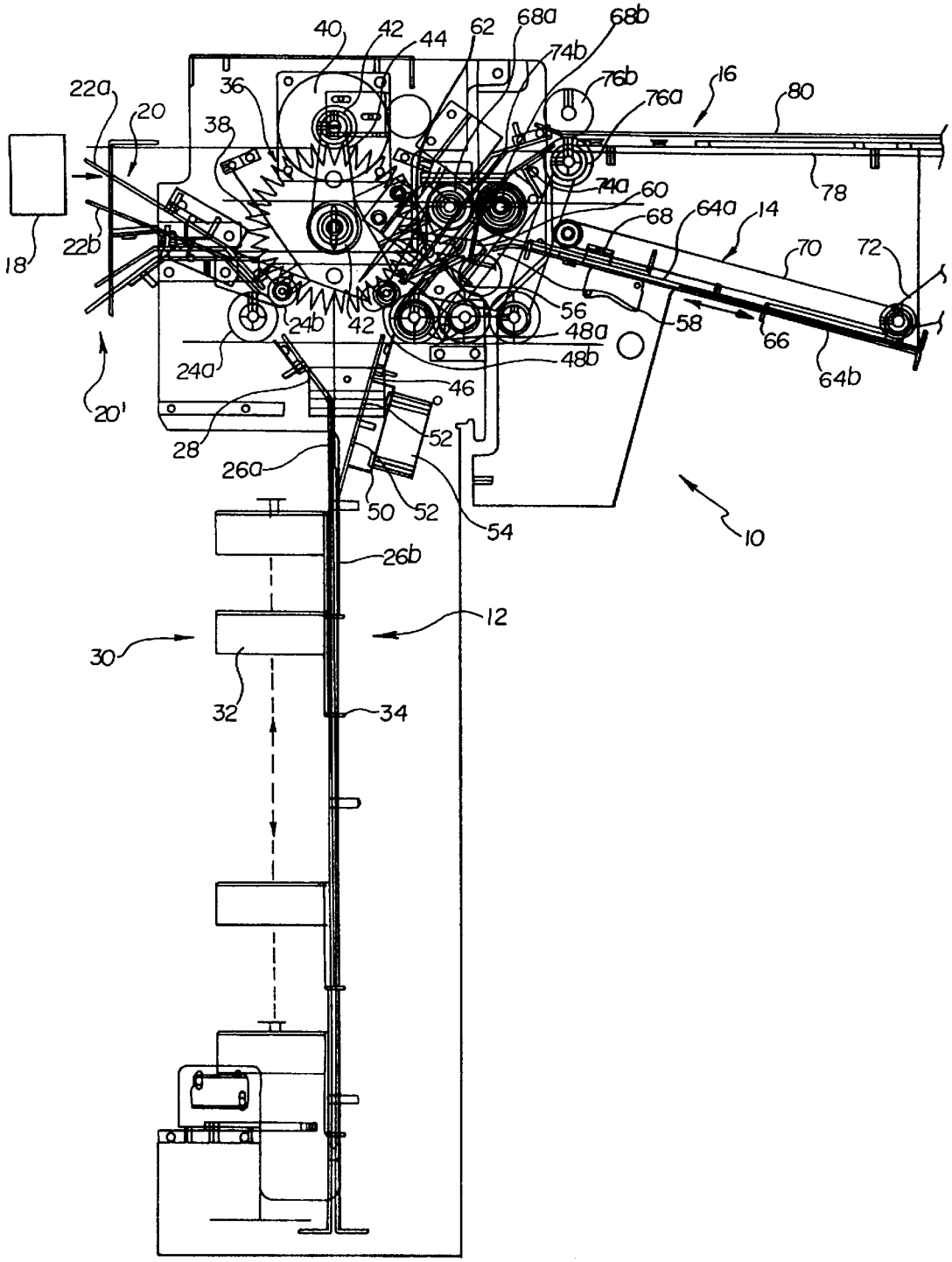
FIG. 1 is a side view of a portion of the module in accordance with the present invention.

With reference now to FIG. 1, a module 10 in accordance with the principles of the present invention is illustrated. The module 10 generally includes a buffering and flipping section 12, a buckle folder 14, and a reorientating section 16, all of which are preferably disposed within a common housing (not shown). The module 10 is designed to be disposed immediately adjacent a high speed printer 18 of a type known in plastic card processing systems so as to receive and handle the printed sheets output from the printer. As should be understood, the elements shown in FIG. 1 extend a certain distance into and out of the plane defined by FIG. 1 so as to accommodate the sizes of the printed sheets.

The high speed printer 18 is of a type known in the art and typically includes an output of up to 60 sheets per minute. The printer 18 is able to print on and process various papers sizes including Letter, modified Statement (i.e. the paper must be at least 7.2 inches wide) and A4 paper, as well as the larger 8½×14 and 8½×17 paper sizes. However, due to the construction of these printers, the Letter, modified Statement and A4 paper sizes exit the printer 18 with the long edge first, while the 8½×14 and 8½×17 paper sizes exit the printer with the short edge first. Therefore, the module 10 must be able to accommodate not only the different paper sizes, but also the different orientations of the sheets exiting the printer. It is to be noted that while the printer is described as only printing on modified Statement paper, the module 10 is able to handle regular Statement paper.

Figure 6:
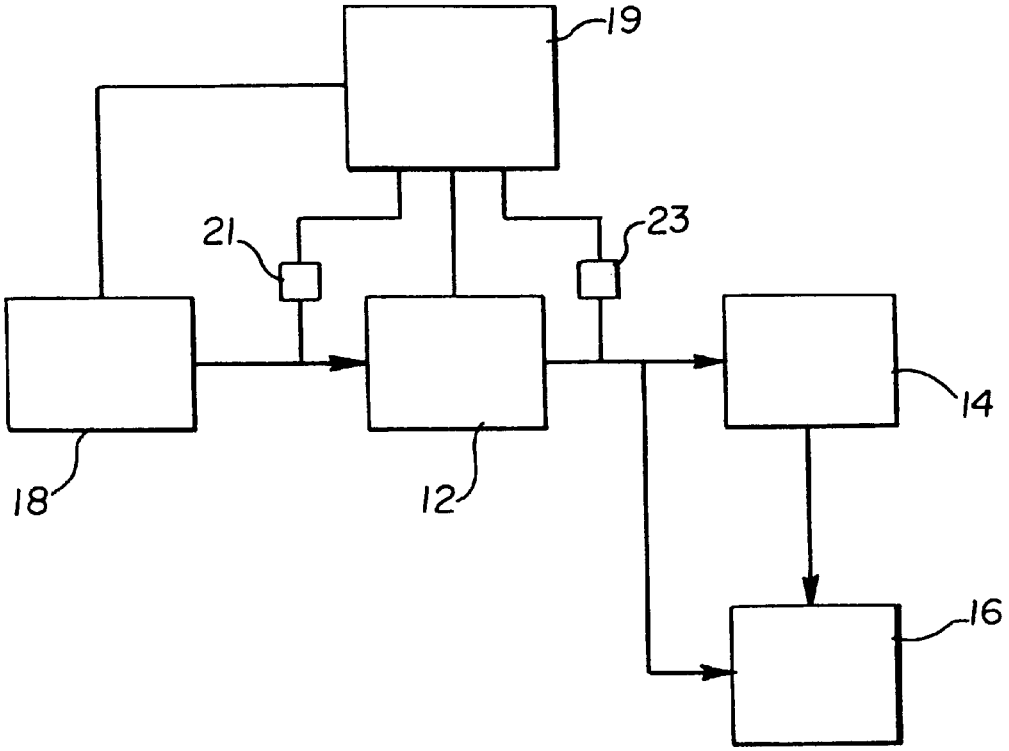
FIG. 6 is a schematic diagram of the module components and associated control system.

In one possible mode of operation, the printer is processing/printing up to six sheets at any one time, with each of the six sheets intended to contain unique personal information for six different customers. With reference now to FIG. 6, the customer information is sent to the printer by a suitable control system or controller 19, which controls operation of the module 10 and the printer 18 such that the total number of sheets within the buffering section 12 and the printer 18 at any one time always is a maximum of six sheets. For instance, if no sheets are in the buffering section 12, the printer 18 is processing/printing six sheets, such that if the system is stopped, all six sheets in progress in the printer can be stored in the buffering section 12. On the other hand, if three sheets are currently in the buffering section 12, then the printer is processing/printing only three sheets, since the buffering section is only capable of holding three more sheets in case the system should be stopped. Should a fault or problem occur somewhere in the card processing system requiring that the system be stopped or paused, the sheets in progress in the printer at the time of stoppage will be completed and output to the buffering and flipping section 12, which buffers or stores the sheets during the stoppage. Upon restarting the system, the buffered sheets can then be matched with the appropriate plastic card.

The module 10 is disposed adjacent the output side of the printer 18, and includes an input paper guide 20 that receives a printed sheet as it is output by the printer. The paper guide 20 is comprised of upper and lower plates 22*a*,22*b* defining a paper path therebetween. The plates 22*a,b* extend adjacent to a pair of input rollers 24*a*,24*b* such that the printed sheet is guided by the plates 22*a,b* between the pair of input rollers 24*a,b* which transport the sheet into the buffering and flipping section 12. The input roller 24*a* is preferably driven through a suitable drive connection to a drive motor within the module 10, and the roller 24*b* is freely rotatable, such that a printed sheet entering the nip of the rollers 24*a,b* is driven by the input rollers into the buffering and flipping section 12.

For a printer 18 that has a lower output height, the paper guide 20 could be replaced by a paper guide 20', as shown in FIG. 1, which would receive the printed sheet from the lower output of the printer and direct the sheet to the rollers 24*a,b*.

The buffering and flipping section 12 includes a pair of vertically extending buffer plates 26*a*,26*b* which are spaced apart from each other a sufficient distance so as to be able to receive a plurality of printed sheets therebetween. Preferably the buffering and flipping section 12 is designed to buffer a maximum of six sheets at any one time, however it should be realized that the section 12 could be designed to accommodate a larger or smaller number of sheets. The buffer plate 26*a* includes an upper end 28 that is angled toward the input rollers 24*a,b* to facilitate entry of a printed sheet into the space between the plates 26*a,b*.

A stop mechanism 30 is associated with the buffer plates 26*a,b* for determining the distance that a printed sheet drops down into the space between the buffer plates. The stop mechanism 30 includes a carriage 32 that is moveable up and down on the buffer plate 26*a*, as illustrated by the dashed line and arrows in FIG. 1, and at least one stop 34 is connected to the carriage 32 and moves therewith. The stop 34 extends between the two plates 26*a,b* and is moveable within a vertical slot formed in each plate to thereby form an adjustable bottom surface against which the leading edges of a printed sheet engages to thereby stop a sheet from dropping down any further between the plates. The position of the carriage 32, and therefore of the stop 34, is preferably controlled by the control system 19, which determines the paper size that is being output from the printer 18 and causes the carriage to move up or down depending upon the paper size. Since the larger paper sizes are output from the printer with the short edge first, the carriage 32 will be moved downward to allow a sheet to drop down between the plates a larger distance. For papers sizes in which the long edge is output first, the carriage moves upward since a sheet does not need to drop as far between the plates.

Figure 2:
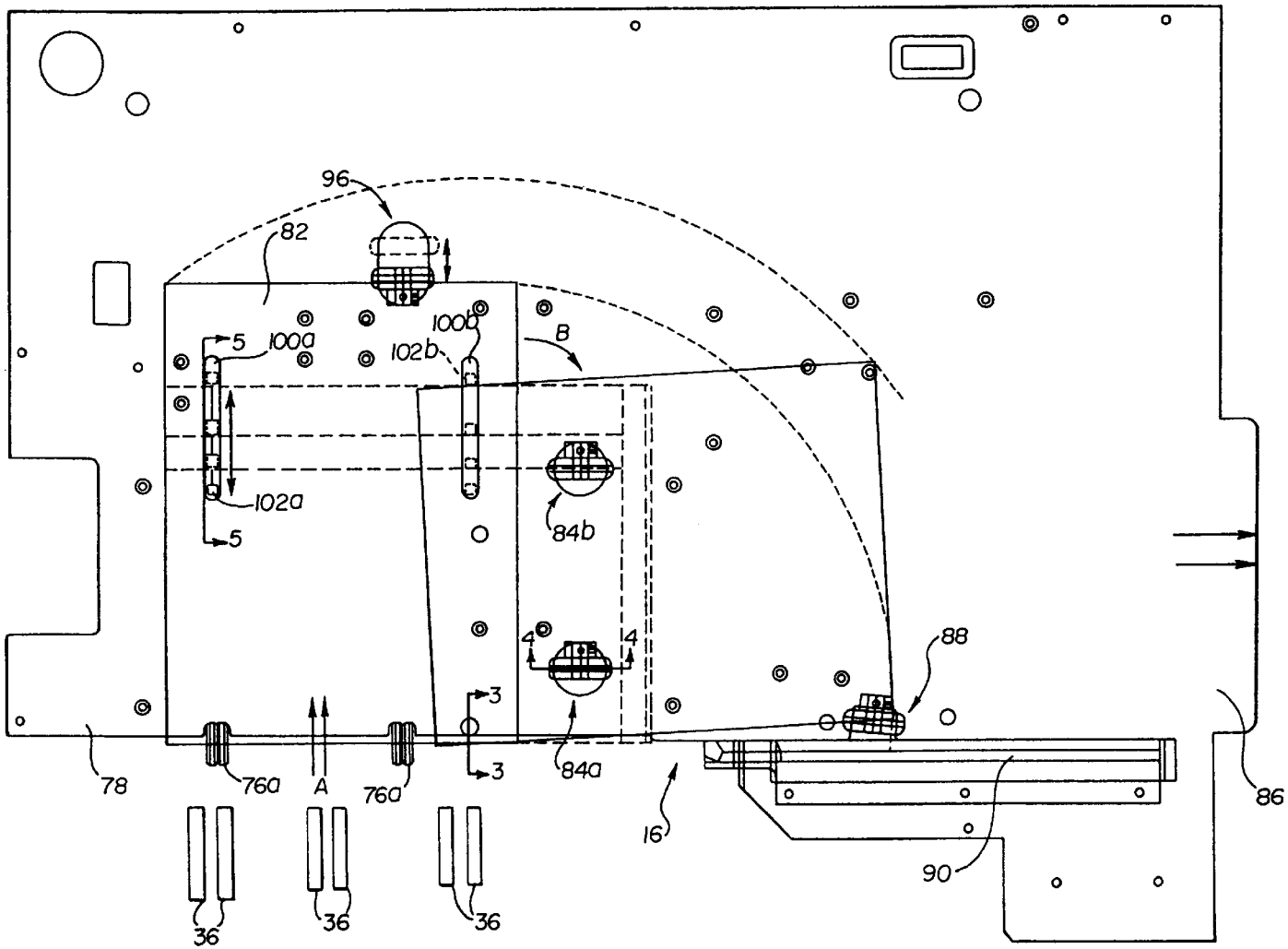
FIG. 2 is a top view of the reorientating section of the present invention.

At least one buffer wheel 36 is rotatably mounted in the module 10 vertically above the buffer plates 26*a,b*, in order to keep the edges of the sheets separated when a plurality of sheets are being buffered, as well as to move the edges of the sheets toward an exit point. As shown in FIG. 2, there are preferably a plurality of spaced buffer wheels 36 within the module, so that the buffer wheels extend along substantially the entire length of the sheets. Each buffer wheel 36 includes a plurality of spaced teeth 38 defined thereon with slots between the teeth. The buffer wheels 36 are rotatable in a counterclockwise direction when only a single sheet is in the section 12, but are pivotable back and forth in both the clockwise and counterclockwise directions during periods when a plurality of sheets are within the section 12, for reasons which will be set forth below.

In use, the slots between the teeth 38 are intended to receive the edge(s) of the sheet(s) that enter the buffering and flipping section 12. In a normal mode of operation, a sheet will enter the section 12 and extend down between the buffer plates 26*a,b*, with the trailing edge of the sheet being flipped by the roller 24*b* into one of the slots between the teeth 38 on the buffer wheels 36 which are rotating in the counterclockwise direction. The edge of the sheet will move with the buffer wheels as they rotate toward an exit point for the sheet for subsequent handling by the buckle folder 14 or reorientating section 16. Thus, during normal operation, only a single sheet is being handled by the buffering section 12 at any one time, with the buffer wheels 36 continuously rotating in a counter-clockwise direction.

As mentioned previously, the only time that the buffering section 12 buffers a plurality of sheets is when the card processing system is stopped. The sheets in progress at the time of stoppage, for instance six sheets, will then be completed by the printer and output to the buffering and flipping section 12. In this case, as a first sheet is driven between the buffer plates, the trailing edge of the first sheet will be flipped into a first one of the slots between the teeth 38 on the buffer wheels. The buffer wheels 36 are then rotated in the counter-clockwise direction a distance of one tooth in preparation for the next printed sheet whose trailing edge will be flipped by the roller 24*b* into the slot immediately adjacent the first slot in which the trailing edge of the first sheet is disposed. This process repeats itself for each of the printed sheets until all of the sheets have exited the printer. It was previously mentioned that the buffering and flipping section 12 is preferably designed to hold up to six printed sheets at any one time, such that the trailing edges of the six sheets will be disposed within six consecutive slots on the buffer wheels 36. In this manner, the trailing edges of the sheets are kept separated, which facilitates exiting of the printed sheets from the buffering and flipping section 12.

When the card processing system is restarted, the sheets are then removed one-by-one from the section 12 and further processed. Print commands will be sent by the control system 19 to the printer as the sheets exit the section 12. As mentioned above, the total number of sheets within the printer and buffering section 12 at any one time is always six or less. Therefore, as one sheet exits the section 12, a print command is sent to the printer to print one sheet. As another sheet exits, another print command is sent, and so on. As shown in FIG. 6, an entry sensor 21 and an exit sensor 23 are located relative to the buffering section 12 so as to sense entry and exiting of the sheets from the buffering section and send appropriate signals to the control system 19, such as a PC, thereby allowing the control system 19 to keep track of the number of sheets within the buffering section at any one time, and send a signal to the printer when space is available in the buffering section. Further, the control system 19 knows the number of sheets currently in progress in the printer, if any. In this manner, the total number of sheets within the buffering section and in progress in the printer remains six or less.

In order to exit the first sheet, the wheels 36 are rotated counter-clockwise a distance of one tooth to bring the edge of the first sheet into the exit position. Since the wheels have been rotated counter-clockwise a distance of one tooth, a new sheet entering the buffering section 12 would have its trailing edge disposed within a slot in the wheels 36 that is spaced from the slot that holds the trailing edge of the last sheet in the buffering section by an intervening slot. Thus each time that the wheels are rotated counter-clockwise to exit a sheet, the wheels must be rotated back in a clockwise direction so that a new sheet entering the buffering section 12 has its trailing edge disposed within a slot that is adjacent to the slot of the last sheet in the buffering section 12. In this manner the sheets are always held within adjacent slots, and the buffering section 12 will always be ready to store the maximum number of sheets. This back and forth movement of the wheels 36 occurs only if there is more than one sheet within the buffering section 12. The exiting of the sheets from the buffering section 12 will occur at a faster rate than the printer is commanded to output printed sheets, such that the normal operating mode of a single sheet going through the buffering section and the printer processing/printing six sheets will be attained again.

The buffer wheels 36 are preferably rotated by a stepper motor 40 that is mounted within the module 10 and is drivingly engaged with the buffer wheels 36 in any suitable manner, such as by pulleys 42 and a drive belt 44. The stepper motor 40 is controlled by the control system 19 to rotate the buffer wheels in the appropriate counter-clockwise or clockwise directions.

The buffer plate 26*b* also includes an angled portion 46 at the top end thereof which guides a sheet as it exits the buffering and flipping section 12. The angled portion 46 extends adjacent to a pair of exit rollers 48*a*,48*b* which transport a sheet toward the buckle folder 14. The exit roller 48*a* is also preferably driven through a suitable drive connection to a drive motor within the module 10, while the roller 48*b* is freely rotatable. The drive motor for the roller 48*a* is preferably the same drive motor used to drive the roller 24*a*, although different drive motors could be used if desired.

The roller 48*b* is used to engage the edge of a sheet that is disposed within one of the slots on the buffer wheels 36 and to move the edge to the nip between the exit rollers 48*a,b* so that the sheet is driven by the exit rollers toward the buckle folder 14. As the buffer wheels 36 are rotated in a counter-clockwise direction, the trailing edge of a sheet is moved closer to the exit roller 48*b*, until the trailing edge of the sheet is engaged by the exit roller 48*b* and moved thereby into the nip between the rollers 48*a,b* so that the sheet is moved toward the buckle folder 14.

In order to hold and stabilize a sheet that is about to be exited from the section 12, the angled portion 46 of the buffer plate 26*b* has mounted thereon a vacuum chamber 50 which is used to hold a portion of the soon to be exited sheet against the angled portion 46. A plurality of holes 52 are formed in the angled portion 46 to allow communication between the vacuum chamber 50 and the sheet. A vacuum is created within the chamber 50 by one or more fans 54 mounted on the chamber. The vacuum created within the chamber 50 is preferably minimized so that it effects only a single sheet when a plurality of sheets are within the buffering section 12.

It should also apparent from the description so far that a sheet is also flipped by the buffering and flipping section 12. As mentioned previously, a printed sheet is output from the printer 18 with its printed side down, i.e. face down. The printed sheet enters the buffering and flipping section 12 with its leading edge moving down between the buffer plates 26*a,b* and with its trailing edge disposed within one of the slots on the buffer wheels 36. As a sheet exits the section 12 however, the trailing edge becomes the leading edge and the sheet exits from the section 12 with the printed side facing upward, so that the sheet is essentially flipped by the section 12.

Exit guide plates 56 are disposed downstream of the exit rollers 48*a,b* for guiding a sheet from the exit rollers, and a guide means 58 is disposed at the exit of the guide plates to selectively guide a sheet to either the buckle folder 14 or the reorientating section 16. The guide means 58 comprises a guide plate 60, which in the embodiment shown is generally L-shaped, although other shapes could be used if desired. The guide plate 60 is pivotally mounted within the module for pivoting movement about an axis 62 between a first, lowered position in which a sheet is guided to the buckle folder 14, and a second, raised position in which a sheet is guided to the reorientating section 16, bypassing the buckle folder.

Movement of the guide plate 60 is preferably controlled by a solenoid mounted within the module and engaged with the plate 60 for driving the plate about the axis 62. The solenoid, in turn, is controlled by the control system 19 which positions the guide plate 60 based upon the size of the paper that is being output from the printer 18. Letter, modified or regular Statement, and A4 sized paper does not need to be folded, and therefore the guide plate 60 will be positioned in its second, raised position so that the buckle folder is bypassed, and a sheet proceeds directly to the reorientating section 16. The larger paper sizes, such as 8½×14 and 8½×17, need to be folded by the buckle folder down to an 8½×11 (Letter) or A4 size, so that the guide plate will be in its first, lowered position to direct a larger sheet to the buckle folder.

The buckle folder 14 is generally conventional in construction and operation, and includes a pair of closely spaced plates 64*a*,64*b* that extend adjacent to the guide plate 60 so that the leading edge of a sheet enters the space between the plates 64*a,b* when the guide plate 60 is in its first, lowered position. At least one adjustable stop 66 is associated with the plates 64*a,b* to contact the leading edge of the sheet and prevent further movement of the sheet into the gap between the plates. When the leading edge of the sheet hits the stop 66, the portion of the sheet that is not located between the plates 64*a,b* will be forced into the nip of a pair of fold rollers 68*a*,68*b* thereby creating a fold in the sheet. Simultaneously, the fold rollers 68*a,b* will drive the now folded sheet to the reorientating section 16. This type of buckle folding operation is well known in the art and therefore further description thereof is not believed to be necessary.

The stop 66 comprises a finger that extends between the two plates 64*a,b* , with the finger being disposed with longitudinal grooves disposed within the plates 64*a,b* to allow adjustment of the position of the stop. By adjusting the position of the stop 66 along the plates 64*a,b*, as shown by the arrow in FIG. 1, the length of the fold created in a sheet can be adjusted, thereby accommodating different paper sizes. The stop 66 is mounted to a carriage 68 which in turn is secured to a carriage belt 70 such that the carriage moves with the carriage belt as the carriage belt is rotated. The carriage belt 70 can be rotated in any suitable manner, such as through a drive belt 72 connected thereto, with the drive belt 72 being rotated by a suitable drive motor or else manually rotated.

Of course, if the printer outputs only Letter, Statement, A4 or any other size of paper that does not need to be folded, the buckle folder 14 could be entirely eliminated from the module 10 along with the guide plate 60.

As mentioned earlier, the fold rollers 68*a,b* drive a sheet to the reorientating section 16 through a pair of guide plates 74*a*,74*b* disposed downstream of the fold rollers. The reorientation section 16 includes a series of spaced inlet rollers 76*a,b* for engaging a sheet and driving it into the section 16. The roller 76*a* is preferably mounted on a lower table 78 of the section 16 and is driven by a motor that can be the same or different motor used to drive the rollers 24*a*,48*a*. The roller 76*b* is freely rotatable on an upper cover 80 that is disposed over the lower table 78. The cover 80 is preferably hinged to the lower table 78 in manner which permits the cover to be raised upward to a non-covering position over the table thereby exposing the upper surface of the table, as well as permitting the cover to be lowered to a covering position over the table, as is shown in FIG. 1.

Turning now to FIG. 2, the reorientating section 16 is illustrated with the cover 80 removed. A sheet 82 enters the section 16 in the direction of the arrow A with either its short edge first as shown in solid lines in FIG. 2, or with its long edge first as shown in dashed lines. It should be realized that a sheet 82 which enters the section with its short edge first is one of the large sized sheets (i.e. 8½×14; 8½×17) output from the printer 18 and which has been folded by the buckle folder 14, and that a sheet 82 which enters with its long edge first is one of the smaller sheets (i.e. Letter, modified Statement, A4) output from the printer and which has not been folded by the buckle folder. Due to this difference in orientation upon entering the section 16, the sheets must be reorientated to ensure that the sheets exit the module 10 with a common orientation for subsequent handling.

The section 16 includes a pair of transport roller assemblies 84*a*,84*b* that transport the sheet in a transverse direction towards an output position 86. A further transport roller assembly 88 is disposed downstream of the assemblies 84*a,b* and located adjacent an edge of the section 16, in order to push the sheet against a reference rail 90 mounted on the table 78 to thereby align the sheets that are on the output position 86. As is shown in FIG. 2, the transport roller assembly 88 is disposed at an angle to the assemblies 84*a,b* so that the sheets are pushed toward the rail 90 as they are engaged by the roller assembly 88.

Figure 4:
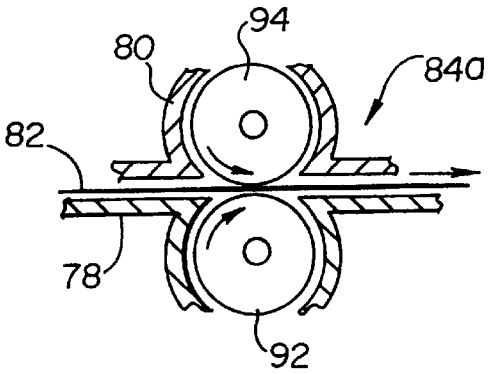
FIG. 4 is a cross-sectional view taken along line 4—4 of FIG. 2 illustrating one of the rotary wheel arrangements for moving the sheets to the output.

With reference to FIG. 4, the details of the roller assembly 84*a* are illustrated therein, with the cover 80 illustrated as being disposed over the table 78. The roller assemblies 84*b* and 88 are identical to the roller assembly 84a and therefore they are not separately illustrated. A roller 92 is rotatably mounted in the table 78 and a corresponding roller 94 is rotatably mounted in the cover 80 to thereby form a nip therebetween through which the sheet 82 passes. The roller 92 is preferably driven by a motor suitably located in the module, while the roller 94 is freely rotatable. In each of the roller assemblies 84*a* and 84*b*, the roller 94 is moveably actuated up and down by a solenoid or other suitable device to allow entry of the paper 82 into the nip of the rollers 92,94 when the roller 94 is up and to pinch the paper between the rollers 92,94 when the roller 94 is down, with the up and down movement of the roller 94 being controlled by the control system 19 based upon the position of the paper. In the roller assembly 88, the roller 94 is fixed and not moveable up and down. The rollers 92,94 project slightly beyond the planes of the table and the cover, respectively, such that they engage opposite sides of the sheet 82 as the sheet passes through the nip. When the roller 92 is rotated in the clockwise direction, the sheet 82 is thus forced to the right in FIG. 2, toward the output position 86.

The section 16 also includes a rotation roller assembly 96 which is used to rotate the sheet 82 in the direction of arrow B (FIG. 2) when the sheet enters with its short edge first. The rotation roller assembly 96 is constructed similarly to the transport roller assemblies 84*a*,84*b*,88, i.e. it has a driven roller mounted on the table and a freely rotatable roller mounted on the cover. Like the roller assembly 88, the roller 94 in the roller assembly 96 is not moveable up and down. The roller 92 associated with the rotation roller assembly 96, however, is adjustable in the direction of arrow A from the position shown in solid lines to the position shown in dashed lines in order to accommodate those sheets which enter the section 16 short edge first and which have been folded by the buckle folder to different lengths, such as sheets that have been folded down to Letter size (length of 11.0 inches) or A4 size (11.7 inches).

Figure 3:
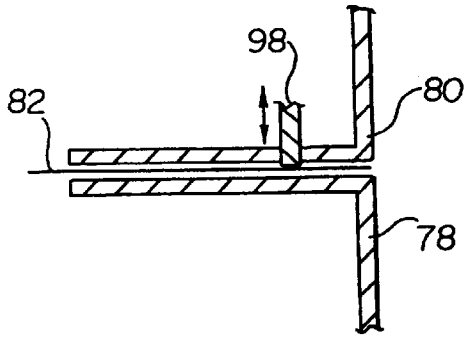
FIG. 3 is a cross-sectional view taken along line 3—3 of FIG. 2 illustrating the mechanism for holding the sheet as it is rotated.

The rollers of the assembly 96 rotate from left to right in FIG. 2, to thereby cause the sheet 82 to rotate. In order for the sheet 82 to be rotated, however, the bottom right corner of the sheet (when viewing FIG. 2) must be held so that the sheet pivots about this corner. FIG. 3 illustrates the mechanism for holding the corner of the sheet as it is rotated, with the cover 80 being included to facilitate the understanding of the mechanism. As shown in FIG. 3, a holding pin 98 is mounted on the cover 80 and is actuatable up and down as indicated by the arrow in order to selectively engage and hold the corner of the sheet as it is rotated and to disengage from the sheet after rotation to allow the sheet to be transported to the output position 86. The holding pin 98 can be actuated in any suitable manner, such as by a solenoid disposed within the cover 80 and which is controlled by the control system 19.

Figure 5:
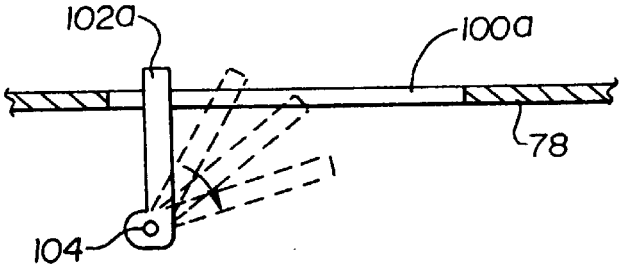
FIG. 5 is a cross-sectional view taken along line 5—5 of FIG. 2, illustrating the adjustable stop mechanism.

An adjustable stop mechanism is also provided for stopping the sheet 82 on the table 78 when the sheet enters the section 16 long edge first. With reference to FIGS. 2 and 5, the stop mechanism includes a pair of slots 100*a*,100*b* formed on the table 78, and a stop finger 102*a*,102*b* extends upwardly into each slot. The fingers are mounted on a common shaft 104 such that when the shaft pivots in the clockwise direction, the fingers pivot therewith and are moved along the slots to discrete positions. The fingers are arranged such that the fingers can extend above the table 78 to thereby stop the sheet in position on the table, or else the fingers can be pivoted to a position below the table 78 so that the fingers do not stop the sheets.

Preferably, the fingers 102*a,b* are provided with a plurality of discrete stop positions where the fingers project above the table 78 to stop the sheet when the sheet enter the section 16 long edge first. In the preferred embodiment, at least three or more discrete stop positions of the fingers are defined. These three stop positions preferably correspond to the Letter, modified Statement and A4 size sheets which enter long edge first, with the particular sheet being stopped by the fingers so it does not reach the rotation roller assembly 96. The fingers 102*a,b* also have a fourth, non-stop position where the fingers are located at the end of the slots 100*a,b* and are disposed below the plane of the table 78. This non-stop position is utilized when a sheet enters short edge first, i.e. the larger size sheets, and allows the sheet to travel up to the rotation roller assembly 96 so as to be rotated thereby.

Therefore, if a sheet enters the reorientating section 16 long edge first (Letter, modified or regular Statement, A4), it does not need to be rotated, and therefore the fingers 102*a,b* will be in one of the stop positions to thereby stop the sheet, as shown by the dashed lines in FIG. 2. The transport roller assemblies 84*a,b* will then be actuated to move the sheet in a direction toward the output position 86, with the transport roller assembly 88 also engaging the sheet and moving it into engagement with the reference rail 90. The sheet 82 will then remain on the output position 86 until it is needed by the next module.

However, if the sheet 82 enters the section 16 short edge first (8½×14; 8½×17; etc.), the fingers will be pivoted forward in the slots 100*a,b* to the fourth, non-stop position, so that the sheet is allowed to reach the rotation roller assembly 96, which is always engaged and therefore rotates all of the time. The holding pin 98 is then actuated downward to hold the corner of the sheet, and the roller assembly 96 rotates the sheet in the direction of arrow B until it engages roller assembly 84*b* which has just been actuated, which then rotates the sheet 82 until the second, solid line position in FIG. 2 is achieved. The roller assembly 88 will complete the rotation of the sheet by pushing it against the rail 90, as well as helping the roller assembly 84*b* move the now rotated sheet to the output position 86.

The present invention thus eliminates the need to throw away sheets upon the occurrence of a stoppage of the card processing system. This results in a reduction in paper costs, as well as eliminating the time spent in reprinting the sheets. The buffering and flipping section 12 allows the sheets to be stored during stoppages, while maintaining proper sheet sequence to facilitate matching with the appropriate plastic card downstream of the module 10 upon restarting of the card processing system.

It is to be understood that while certain embodiments of the present invention have been illustrated and described, the invention is not limited to the specific forms or arrangements of the parts described and shown.

We claim:

1. A module for processing printed sheets that are output from a printer, comprising:

an input receiving the printed sheets from the printer;

a buffering and flipping section capable of holding and flipping a plurality of the printed sheets;

a folder capable of folding each printed sheet, said folder being located downstream from said buffering and flipping section;

a reorientating section for reorientating each printed sheet, said reorientating section being located downstream from said buffering and flipping section;

a guide downstream of said buffering and flipping section for selectively guiding the printed sheets to either said folder or said reoreintating section; and an output position receiving each printed sheet from the reorientating section.

2. The module according to claim 1, wherein said buffering and flipping means includes at least one buffer wheel capable of keeping edges of the plurality of sheets separated.

3. The module according to claim 2, wherein said buffer wheel includes a plurality of teeth on an outer periphery thereof, said teeth being separated by slots; and the edges of the plurality of sheets being disposable within a respective plurality of said slots.

4. The module according to claim 3, wherein said plurality of slots are adjacent to each other.

5. The module according to claim 2, wherein said buffering and flipping means further includes vacuum chamber means for stabilizing one of the plurality of sheets.

6. The module according to claim 1, wherein each sheet enters the reorientating means in a first direction, and said reorientating means includes means for rotating the sheets.

7. The module according to claim 6, wherein said means for rotating comprises a holding pin and a rotating roller engageable with the sheets, said rotating roller rotating in a direction transverse to the first direction.

8. The module according to claim 7, wherein said rotating roller is adjustable in a direction along the first direction.

9. The module according to claim 6, further including means for moving the sheets in a second direction transverse to the first direction.

10. The module according to claim 9, wherein said means for moving comprises a first rotating roller, said first rotating roller rotating in a direction transverse to the first direction.

11. The module according to claim 10, wherein said reorientating means includes a reference edge adjacent the output position, and further including a second rotating roller adjacent the reference edge, said second rotating roller being disposed at an angle relative to said first rotating roller.

12. The module according to claim 9, further including an adjustable stop mechanism for controlling the position of the sheets as the sheets enter the reorientating means.

13. An apparatus for processing printed sheets, comprising:

a buffering section capable of holding a plurality of the printed sheets, said buffering section including a pair of generally parallel, spaced apart buffer plates defining a buffer space therebetween for receiving the plurality of printed sheets and a buffer wheel adjacent the buffer plates and adapted for engagement with an edge of each of the plurality of sheets held within the buffer space for separating the edges of the plurality of printed sheets;

a folder capable of folding each printed sheet, said folder being located downstream from said buffering section;

a reorientating section receiving the printed sheets and capable of reorientating the printed sheets, said reorientating section being located downstream from said buffering section; and a guide downstream of said buffering section for selectively guiding the printed sheets to either said folder or said reorientating section.

14. The apparatus according to claim 13, wherein the reorientating section receives the printed sheets in a first orientation, and the reorientating section includes at least one rotating roller and a pivot mechanism which are engageable with the printed sheets so as to rotate the printed sheets to a second orientation.

15. The apparatus according to claim 14, wherein each printed sheet is rotated about 90 degrees.

16. The apparatus according to claim 13, wherein the reorientating section receives the printed sheets in a first orientation, and the reorientating section includes at least one rotating roller capable of moving each printed sheet while in the first orientation.

17. The apparatus according to claim 13, wherein said buffer wheel includes a plurality of teeth on an outer periphery thereof, said teeth being separated by slots; and the edges of the plurality of sheets being disposable within a plurality of said slots.

18. An apparatus for processing printed sheets, comprising:

a buffering section capable of holding a plurality of the printed sheets;

a buckle folder capable of folding the printed sheets, said buckle folder being located downstream from said buffering section;

a reorientating section receiving the printed sheets, said reorientating section being located downstream from said buffering section, and the printed sheets entering said reorientating section in a first direction, and the reorientating section includes means for rotating the printed sheets and means for moving the printed sheets in a direction transverse to the first direction; and an adjustable guide downstream of said buffering and flipping section, said guide having a first position at which the printed sheets are guided to the buckle folder and a second position at which the printed sheets are guided to the reorientating section.

* * * * *